US009809406B2

(12) United States Patent
Onishi

(10) Patent No.: US 9,809,406 B2
(45) Date of Patent: Nov. 7, 2017

(54) SHEET CONVEYING DEVICE HAVING A CORRUGATION MEMBER AND IMAGE FORMING APPARATUS THEREWITH

(71) Applicant: KYOCERA Document Solutions Inc., Osaka (JP)

(72) Inventor: Yuzo Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/346,353

(22) Filed: Nov. 8, 2016

(65) Prior Publication Data

US 2017/0129732 A1 May 11, 2017

(30) Foreign Application Priority Data

Nov. 9, 2015 (JP) ..... 2015-219372

(51) Int. Cl.

| | |
|---|---|
| ***B65H 31/26*** | (2006.01) |
| ***B65H 29/70*** | (2006.01) |
| ***B65H 29/12*** | (2006.01) |
| ***G03G 15/00*** | (2006.01) |
| ***B65H 29/14*** | (2006.01) |
| ***B65H 85/00*** | (2006.01) |

(52) U.S. Cl.

CPC ..... *B65H 29/70* (2013.01); *B65H 29/12* (2013.01); *B65H 29/125* (2013.01); *B65H 29/14* (2013.01); *B65H 85/00* (2013.01); *G03G 15/6529* (2013.01); *G03G 15/6552* (2013.01); *B65H 2301/4212* (2013.01); *B65H 2301/5122* (2013.01); *B65H 2301/51214* (2013.01); *B65H 2403/41* (2013.01); *B65H 2403/732* (2013.01); *B65H 2403/942* (2013.01); *B65H 2404/693* (2013.01); *B65H 2601/521* (2013.01); *B65H 2801/06* (2013.01); *G03G 2215/00679* (2013.01)

(58) Field of Classification Search

CPC ..... B65H 2301/5121; B65H 2405/111; B65H 2405/1113; B65H 29/70; B65H 31/00; B65H 29/12; B65H 29/125; B65H 2301/5122; B65H 2403/41; B65H 2403/732; G03G 15/6529

USPC ..... 271/209, 220, 221, 207

See application file for complete search history.

(56) References Cited

FOREIGN PATENT DOCUMENTS

JP 2006-62855 A 3/2006

*Primary Examiner* — Thomas Morrison

(74) *Attorney, Agent, or Firm* — Stein IP, LLC

(57) ABSTRACT

A sheet conveying device has a pair of upper discharge rollers including a first discharge roller and a first following roller, a second discharge tray, a corrugation member, and a moving mechanism. The first discharge roller is rotatable in forward and reverse directions. The corrugation member corrugates the sheet by making contact with its sheet face. The moving mechanism moves the corrugation member between a first position, where it makes contact with the sheet face of the sheet, and a second position, where it is located above, away from, the nip portion of the pair of upper discharge rollers. An image forming apparatus incorporates such a sheet conveying device.

9 Claims, 4 Drawing Sheets

SHEET CONVEYING DEVICE HAVING A CORRUGATION MEMBER AND IMAGE FORMING APPARATUS THEREWITH

INCORPORATION BY REFERENCE

This application is based upon and claims the benefit of priority from the corresponding Japanese Patent Application No. 2015-219372 filed on Nov. 9, 2015, the entire contents of which are incorporated herein by reference.

BACKGROUND

The present disclosure relates to sheet conveying devices for conveying sheets, and to image forming apparatuses provided with a sheet conveying device.

Conventionally, as sheet conveying devices for conveying sheets, those provided in image forming apparatuses are known. The main body of an image forming apparatus has a sheet discharge section into which sheets are discharged. A sheet conveying device discharges a sheet having an image formed on it toward the sheet discharge section.

In the image forming apparatus, for the fixing of developer to a sheet, the sheet is heated in a predetermined fixing device. As a result, the sheet discharged into the sheet discharge section may be curled, resulting in poor sheet stackability. According to a typical conventional technology, the sheet discharge section is provided with a corrugation member. The corrugation member presses the sheet face of the sheet discharged into the sheet discharge section and thereby corrugates the sheet. As a result, the sheet becomes less curled, leading to improved sheet stackability.

In the image forming apparatus, when two-sided printing, that is, printing in which images are formed on both sides of a sheet, is performed, the sheet having an image formed on one side is partly discharged to over the sheet discharge section and is then switched back to be conveyed into a predetermined two-sided conveyance passage. At this time, if the sheet is switched back with the corrugation member kept pressing its sheet face, when the sheet is conveyed into the two-sided conveyance passage, it produces abnormal noise, which is undesirable.

SUMMARY

According to one aspect of the present disclosure, a sheet conveying device includes a housing, a pair of conveying rollers, a sheet stacking portion, a driver, a corrugation member for corrugating a sheet, and a moving mechanism for moving the corrugation member. The pair of conveying rollers includes a first roller which is rotatably supported on the housing and a second roller which follows the first roller to rotate, the pair of conveying rollers forming between the first and second rollers a nip portion through which a sheet passes. Onto the sheet stacking portion, sheets conveyed by the pair of conveying rollers are stacked. The driver rotates the first roller selectively either in a first rotation direction, in which the pair of conveying rollers conveys the sheet toward the sheet stacking portion, or in a second rotation direction, which is opposite to the first rotation direction. The corrugation member corrugates the sheet by making contact with the sheet face of the sheet passing through the nip portion. The moving mechanism moves, according to the rotation direction of the first roller, the corrugation member between a first position, where the corrugation member makes contact with the sheet face, and a second position, where the corrugation member is located away from the nip portion.

According to another aspect of the present disclosure, an image forming apparatus includes an image forming section which forms an image on a sheet and a sheet conveying device as described above.

DETAILED DESCRIPTION

Figure 1:
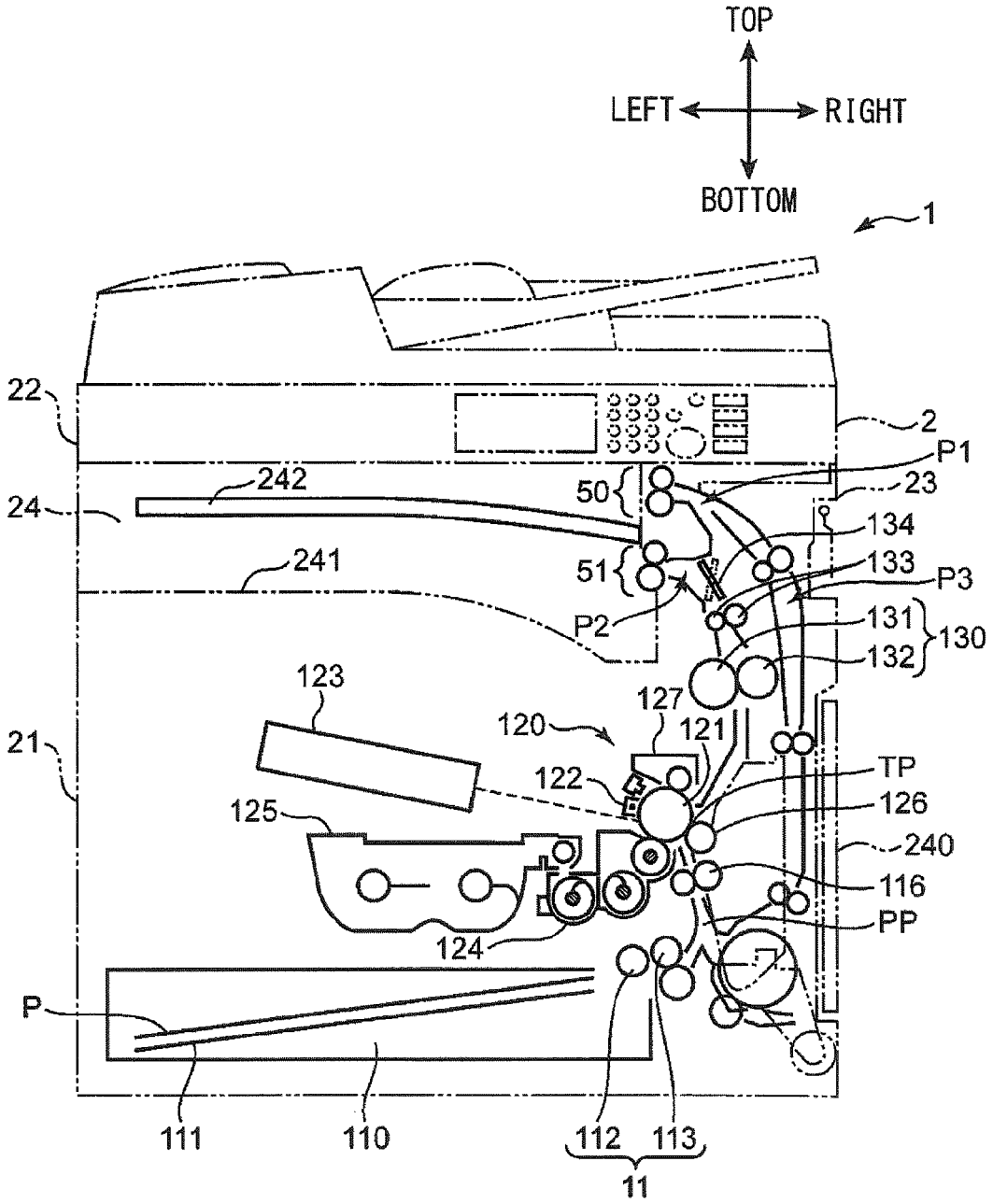
FIG. 1 is a sectional view of an image forming apparatus according to one embodiment of the present disclosure.

An embodiment of the present disclosure will be described below with reference to the accompanying drawings. FIG. 1 is an interior sectional view of an image forming apparatus 1 according to one embodiment of the present disclosure. The image forming apparatus 1 shown in FIG. 1 is a so-called monochrome printer, but may instead be, in other embodiments, a color printer, a facsimile machine, a multifunction peripheral provided with the functions of those, or any other device for forming a toner image on a sheet. As used in the following description, the terms like "top," "bottom," "front," "rear," "left", and "right" are merely intended to clarify description, and are in no way meant to limit the principle of the image forming apparatus. In the following description, the term "sheet" covers copy paper, coated paper, OHP sheets, cardboard, postcards, tracing paper, any other sheet material that is subjected to image formation processing, and any sheet material that is subjected to arbitrary processing other than image formation processing.

The image forming apparatus 1 includes a main housing 2 which is substantially in the shape of a rectangular parallelepiped. The main housing 2 includes a lower housing 21 which is substantially in the shape of a rectangular parallelepiped, an upper housing 22 which is arranged over the lower housing 21 and which is substantially in the shape of a rectangular parallelepiped, and a connecting housing 23 (housing) which connects the lower and upper housings 21 and 22 together. The connecting housing 23 extends along the right and rear edges of the main housing 2. In a discharge space 24 surrounded by the lower, upper, and connecting housings 21, 22, and 23, sheets P having undergone print processing are discharged. Notably, in the embodiment, sheets P are discharged onto a first sheet discharge tray 241, which is arranged on a top face part of the lower housing 21, and onto a second sheet discharge tray 242 (sheet stacking portion), which is arranged over the lower housing 21. On the right side face of the lower housing 21, a hand feed tray 240 is arranged. The hand feed tray 240 is swingable up and down at its top end about its bottom end as the fulcrum.

The image forming apparatus 1 includes a sheet feed cassette 110, a sheet feeding section 11, a pair of registration rollers 116, and an image forming section 120. The sheet feeding section 11 includes a pickup roller 112 and a sheet feed roller 113. The sheet feeding section 11 feeds out a sheet P into a sheet conveyance passage PP. The sheet conveyance passage PP is a conveyance passage that is arranged so as to extend from the sheet feeding section 11 via the pair of registration rollers 116 to pass through a transfer position TP arranged inside the image forming section 120.

The sheet feed cassette 110 stores sheets P in it. The sheet feed cassette 110 can be drawn out of the lower housing 21 in the front direction (the near-side direction relative to the plane of FIG. 1). The sheet feed cassette 110 includes a lift plate 111 which supports the sheets P. The lift plate 111 is inclined so as to raise the leading edges of the sheets P. The pickup roller 112 is arranged on the leading edge of the sheets P raised up by the lift plate 111, and takes out a sheet P from the sheet feed cassette 110.

The sheet feed roller 113 is arranged on the downstream side of the pickup roller 112 in the sheet conveyance direction. The sheet feed roller 113 feeds out the sheet P further to the downstream side in the sheet conveyance direction. The pair of registration rollers 116 regulates the position of the sheet in the direction perpendicular to the sheet conveyance direction. Thus, the position of the image formed on the sheet P is adjusted. The pair of registration rollers 116 conveys the sheet P in a manner coordinated with the timing of transfer of the toner image to the sheet P in the image forming section 120. The pair of registration rollers 116 also has the function of correcting skew of the sheet P.

The image forming section 120 includes a photosensitive drum 121, an electrostatic charger 122, an exposing device 123, a developing device 124, a toner container 125, a transfer roller 126, and a cleaning device 127.

The image forming apparatus 1 further includes, on the downstream side of the image forming section 120 in the conveyance direction, a fixing device 130 for fixing the toner image on the sheet P. The fixing device 130 includes a heating roller 131 for melting the toner on the sheet P and a pressing roller 132 for keeping the sheet P in close contact with the heating roller 131. As the sheet P passes between the heating roller 131 and the pressing roller 132, the toner image is fixed to the sheet P.

The image forming apparatus 1 further includes a pair of intermediate conveying rollers 133 arranged on the downstream side of the fixing device 130, a switch guide 134 arranged on the downstream side of the pair of intermediate conveying rollers 133, a pair of upper discharge rollers 50, and a pair of lower discharge rollers 51. In the lower and connecting housings 21 and 23, an upper discharge passage P1, a lower discharge passage P2, and a two-sided conveyance passage P3 which are coupled to the sheet conveyance passage PP. The upper discharge, lower discharge, and two-sided conveyance passages P1, P2, and P3 are passages through which sheets P are conveyed.

The pair of intermediate conveying rollers 133 conveys the sheet P having undergone fixing by the fixing device 130 to the downstream side in the sheet conveyance direction. The switch guide 134 has the function of switching the conveyance direction of the sheet P on the downstream side in the sheet conveyance direction. By the switch guide 134, the conveyance destination of the sheet P is switched between the upper and lower discharge passages P1 and P2. The pair of lower discharge rollers 51 is arranged to the left of the switch guide 134, at the terminal end of the lower discharge passage P2, and discharges the sheet P conveyed by the pair of intermediate conveying rollers 133 onto the first sheet discharge tray 241. The pair of upper discharge rollers 50 is arranged over the pair of lower discharge rollers 51, at the terminal end of the upper discharge passage P1, and discharges the sheet P conveyed by the pair of intermediate conveying rollers 133 onto the second sheet discharge tray 242, which is attached over the first sheet discharge tray 241.

The two-sided conveyance passage P3 is used when the sheet P is subjected to two-sided printing. After an image is formed on a sheet face of the sheet P, part of the sheet P is discharged into the discharge space 24. At this time, the upstream side of the sheet P in the conveyance direction is nipped by the pair of upper discharge rollers 50. When the rotation direction of the pair of upper discharge rollers 50 is reversed, the sheet P is switched back, and is then conveyed into the two-sided conveyance passage P3. Thereafter, the sheet P is conveyed once again into the sheet conveyance passage PP, which is on the upstream side of the transfer nip portion TP, and then has an image formed on the other sheet face.

Figure 2:
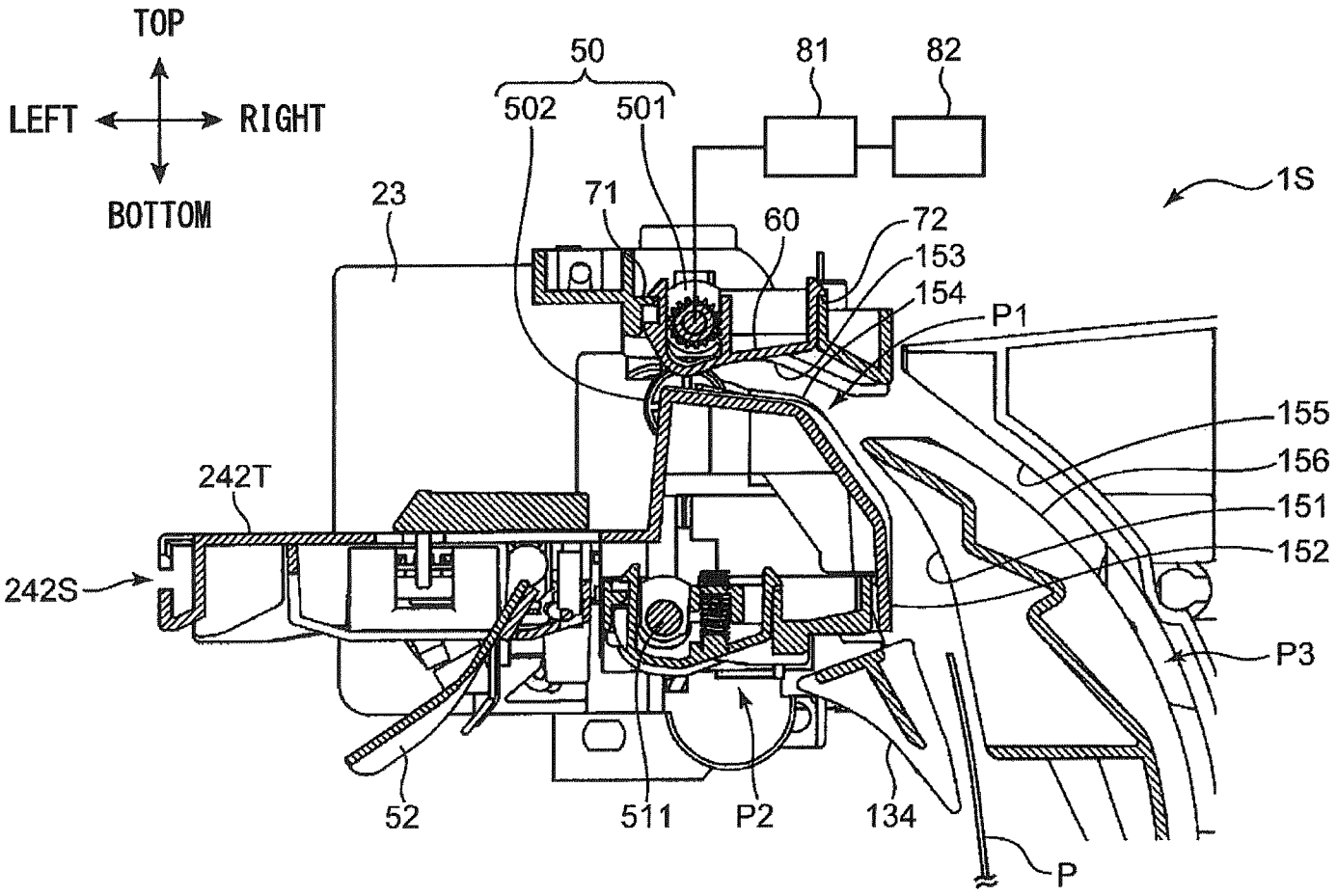
FIG. 2 is a sectional view of a sheet conveying device in the image forming apparatus according to the embodiment of the present disclosure.
Figure 3:
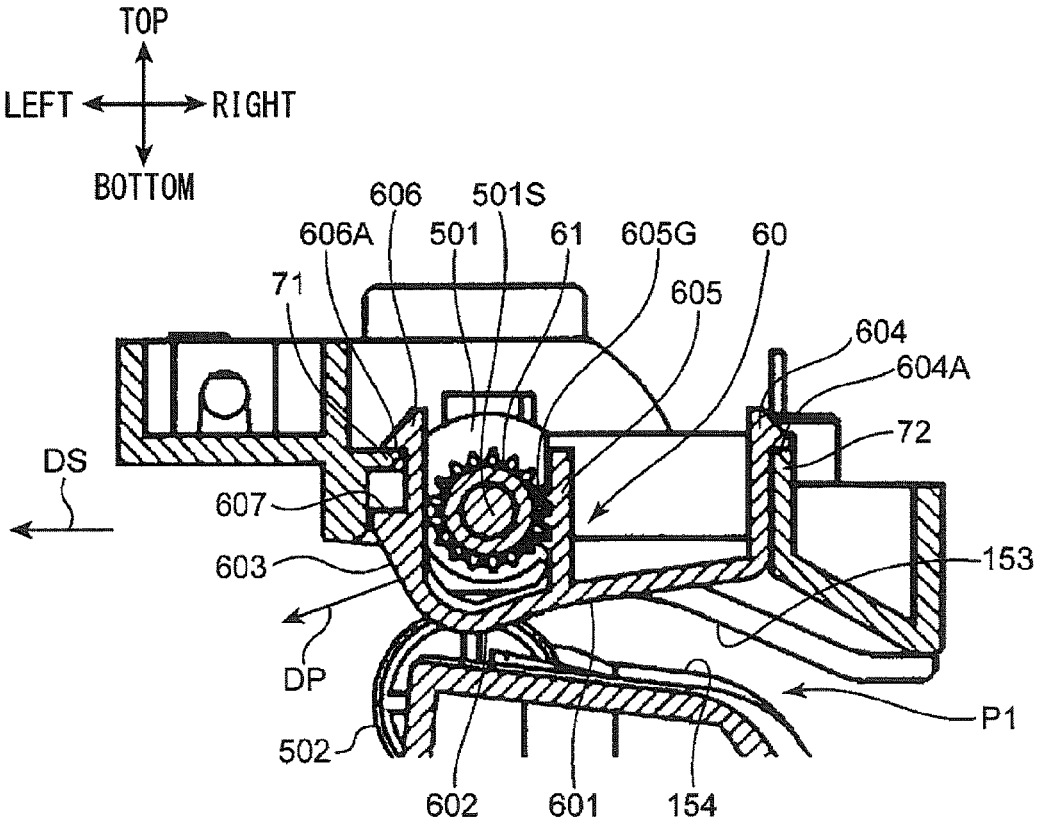
FIG. 3 is an enlarged sectional view of part of the sheet conveying device in FIG. 2.
Figure 4:
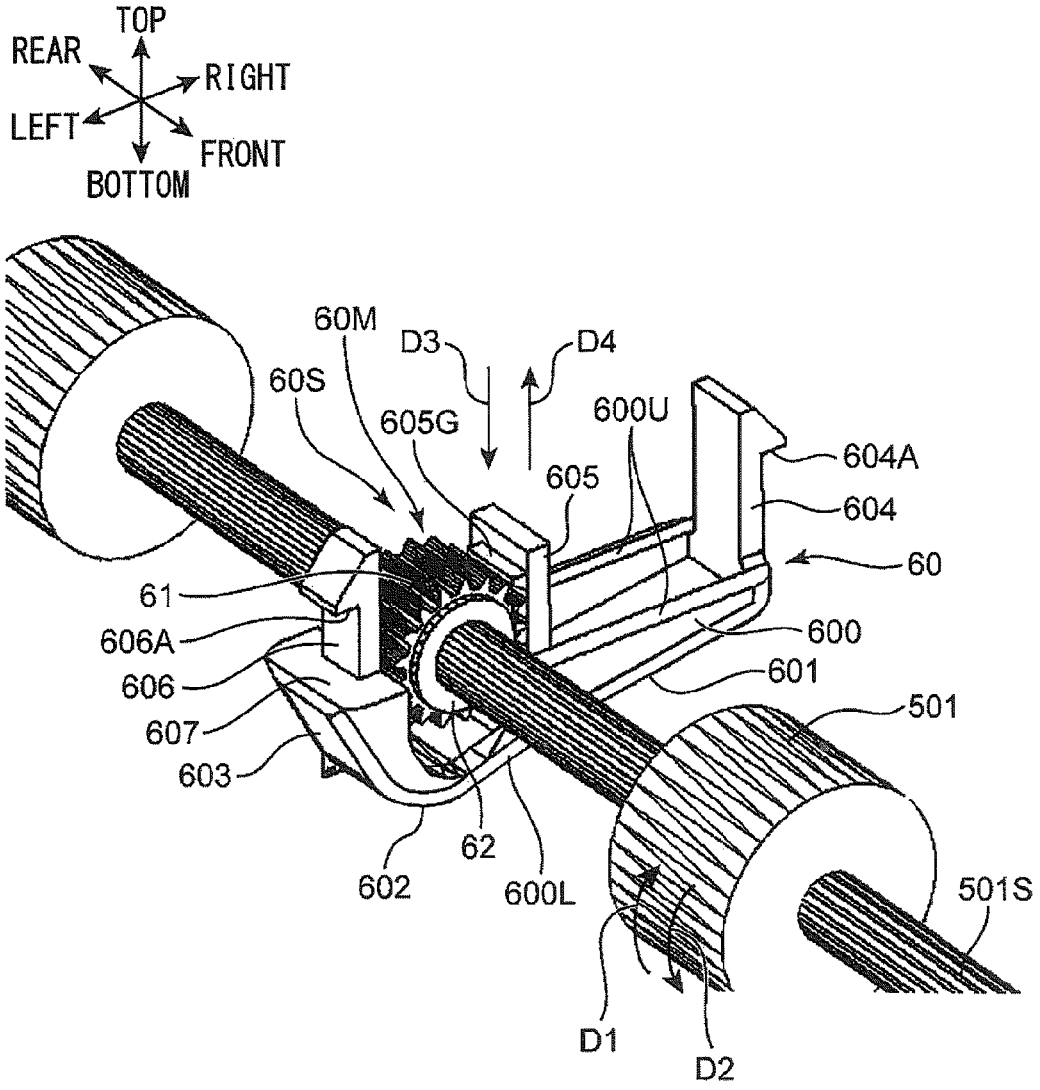
FIG. 4 is a perspective view of a corrugation member and a moving mechanism in the sheet conveying device according to the embodiment of the present disclosure.

Next, with reference to FIGS. 2 to 4, a sheet conveying device 1S according to the embodiment will be described in detail. FIG. 2 is a sectional view of the sheet conveying device 1S in the image forming apparatus 1 according to the embodiment. FIG. 3 is an enlarged sectional view of part of the sheet conveying device 1S in FIG. 2. FIG. 4 is a perspective view of a corrugation member 60 and a moving mechanism 60S in the sheet conveying device 1S in the embodiment.

The sheet conveying device 1S is provided in the connecting housing 23 (housing). The sheet conveying device 1S discharges a sheet P onto the first or the second discharge tray 241 or 242. The sheet conveying device 1S also conveys the sheet P toward the two-sided conveyance passage P3 mentioned previously. The sheet conveying device 1S includes, in addition to the pair of upper discharge rollers 50 and the pair of lower discharge rollers 51 mentioned previously, a roller shaft 501S (FIG. 3) (shaft), the corrugation member 60, a transmission gear 61 (rotary gear), a torque limiter 62, a driver 81 and a drive controller 82.

The pair of upper discharge rollers 50 (pair of conveying rollers) includes a first discharge roller 501 and a first following roller 502. The first discharge roller 501 is rotatably supported on the connecting housing 23. Specifically, the first discharge roller 501 is fixed to the circumferential face of the roller shaft 501S. Actually, the first discharge roller 501 comprises a plurality of first discharge rollers 501 arranged at intervals from each other in the axial direction of the roller shaft 501S. The roller shaft 501S rotatably supports the first discharge roller 501, and is pivoted on unillustrated bearings provided on the connecting housing 23. The first following roller 502 follows the first discharge roller 501 to rotate, and forms, between itself and the first discharge roller 501, a nip portion through which a sheet P passes. Also the first following roller 502 actually comprises a plurality of first following rollers 502 arranged opposite the first discharge rollers 501 respectively, and are each rotatably supported on unillustrated bearings provided in the connecting housing 23. FIG. 2 shows a second discharge roller 511, which is one of the rollers constituting the pair of lower discharge rollers 51. Like the pair of upper discharge rollers 50, the pair of lower discharge rollers 51 includes a following roller arranged opposite the second discharge roller 511. An actuator 52 arranged to the left of the second discharge roller 511 presses the sheet face of the sheet P discharged onto the first sheet discharge tray 241, and detects fullness of the first sheet discharge tray 241.

The corrugation member 60 makes contact with, from above, the sheet face of the sheet P passing through the nip portion between the pair of upper discharge rollers 50, and thereby corrugates the sheet P. Even if a sheet P heated and pressed by the fixing device 130 is curled, the corrugation member 60 removes the curl of the sheet P. This helps improve the stackability of sheets P on the second sheet discharge tray 242.

As shown in FIG. 4, the corrugation member 60 is arranged at a position at an interval, in the axial direction of the roller shaft 501S, from the pair of upper discharge rollers 50 (the first discharge roller 501). In a case where a plurality of pair of upper discharge rollers 50 are arranged at intervals from each other in the axial direction, it is preferable that the corrugation member 60 be arranged between adjacent pairs of pairs of upper discharge rollers 50. The corrugation member 60 is slidably supported on a left support portion 71 and a right support portion 72, which will be described later, of the connecting housing 23. Moreover, as shown in FIG. 3, when seen on a sectional plane perpendicular to the axial direction of the roller shaft 501S, the corrugation member 60 is arranged so as to extend beyond the nip portion to the upstream and downstream sides in the discharge direction of the sheet P (the direction indicated by arrow DS in FIG. 3).

With reference to FIG. 4, the corrugation member 60 includes a sheet pressing portion 600. The sheet pressing portion 600 is the main part of the corrugation member 60, and has the function of making contact with a sheet P. The sheet pressing portion 600 has a shape that extends long in the left/right direction with a predetermined width in the sheet width direction (the front/rear direction). In the sheet pressing portion 600, top end faces 600U, which are composed of a pair of ribs, extend horizontally, and a bottom end face 600L is composed of a plurality of faces. Specifically, the sheet pressing portion 600 includes, as the parts constituting the bottom end face 600L, an upstream guide face 601, a corrugation portion 602, and a downstream guide face 603. The upstream guide face 601 is located in a part of the bottom end face of the sheet pressing portion 600 on the upstream side of the discharge direction of the sheet P. The upstream guide face 601 is an inclined face that descends forward in the discharge direction, and guides the leading edge of the sheet P to the corrugation portion 602. The corrugation portion 602 connects to a tip end part of the upstream guide face 601. The corrugation portion 602 is arranged, in the axial direction of the roller shaft 501S, opposite the nip portion of the pair of upper discharge rollers 50 (FIG. 3). The corrugation portion 602 is an arc-shaped face that is convex downward. The downstream guide face 603 connects to a downstream-side end part of the corrugation portion 602. That is, the downstream guide face 603 is arranged on the downstream side of the nip portion of the pair of upper discharge rollers 50 in the discharge direction of the sheet P. The downstream guide face 603 is an inclined face ascending forward in the discharge direction of the sheet P. As shown in FIG. 3, The forward-descending inclination of the upstream guide face 601 is given a sharper angle than the forward-ascending inclination of the downstream guide face 603.

The corrugation member 60 further includes a first hook 604, a rack portion 605, and a second hook 606.

The first hook 604 is formed to protrude upward from the right end side of a top face part of the sheet pressing portion 600. The first hook 604 has a hook part that protrudes rightward (FIG. 4). The hook part has a first abutting portion 604A (a first locking portion). The first abutting portion 604A can make contact with the right support portion 72, which will be described later.

The rack portion 605 is a plate-shaped part protruding upward that is located substantially in a middle part of the top face part of the sheet pressing portion 600, to the left of the first hook 604. The rack portion 605 is arranged to point in the left/right direction. The rack portion 605 has a rack gear 605G. The rack gear 605G comprises a plurality of cogs arranged at intervals from each other in the up/down direction, on the left side face of the rack portion 605. The rack gear 605G can engage (mesh) with the transmission gear 61, which will be described later.

The rack portion 605 is formed to protrude upward from the left end side of the top face part of the sheet pressing portion 600. The second hook 606 has a hook part that protrudes leftward (FIG. 4). The hook part has a second abutting portion 606A (a first locking portion). The second abutting portion 606A can make contact with the left support portion 71, which will be described later. As shown in FIG. 4, on the left end side of the corrugation member 60, a guide groove portion 60M is formed which has as its side faces the rack portion 605 and the second hook 606. The guide groove portion 60M permits the corrugation member 60 to move up and down.

As shown in FIG. 4, the second hook 606 is arranged at a position displaced rightward from the left end edge of the top face part of the sheet pressing portion 600. As a result, to the left of the second hook 606, a third abutting portion 607 (a second locking portion) is arranged which is a top end face of the sheet pressing portion 600. The third abutting portion 607 can make contact with the left support portion 71, which will be described later. The third abutting portion 607 is arranged below the second abutting portion 606A.

In the embodiment, the surface condition of the corrugation member 60 is set such that the frictional force that occurs between the corrugation member 60 and a sheet P is smaller than the frictional force that occurs between the first discharge roller 501 and the sheet P. Thus, while the sheet P is being conveyed by the pair of upper discharge rollers 50, even if the corrugation member 60 makes contact with the sheet face of the sheet P, the sheet P is prevented from severe hindrance of its conveyance.

The transmission gear 61 is a rotary gear that is fitted around (penetrated through by) the roller shaft 501S. As shown in FIG. 4, the transmission gear 61 is arranged between the rack portion 605 and the second hook 606 of the corrugation member 60. The rack gear 605G of the rack portion 605 is arranged on the upstream side in the discharge direction of the sheet P.

The torque limiter 62 is arranged between the transmission gear 61 and the roller shaft 501S. Specifically, the torque limiter 62 is fitted inside the cylinder of the transmission gear 61. The torque limiter 62 is fitted around the roller shaft 501S. The torque limiter 62 either lets the transmission gear 61 rotate together with the roller shaft 501S or lets the roller shaft 501S rotate idly relative to the transmission gear 61. In other words, so long as the load torque that acts on the transmission gear 61 is equal to or less than a predetermined value, the transmission gear 61 rotates together with the roller shaft 501S. On the other hand, when the load torque that acts on the transmission gear 61 exceeds the predetermined value, the roller shaft 501S rotates idly relative to the transmission gear 61.

The driver 81 is provided in the connecting housing 23. The driver 81 is composed of an unillustrated motor and a gear train, of which none are illustrated. The driver 81 is coupled to the roller shaft 501S, and has the function of rotating the first discharge roller 501 (roller shaft 501S) selectively either in a first rotation direction for conveying a sheet P toward the second sheet discharge tray 242 or in a second rotation direction opposite to the first rotation direction. The drive controller 82 controls the driver 81, and thereby controls the turning-on and off of the rotation of the first discharge roller 501 and the rotation direction of the first discharge roller 501. The drive controller 82 is composed of, among others, a CPU (central processing unit), ROM (read-only memory) for storing a control program, and RAM (random-access memory) used as a working area for the CPU.

With reference to FIG. 2, the connecting housing 23 includes a discharge face 242T, a tray attachment portion 242S, the left support portion 71, and the right support portion 72. The connecting housing 23 further includes a first guide face 151, a second guide face 152, a third guide face 153, a fourth guide face 154, a fifth guide face 155, and a sixth guide face 156.

The discharge face 242T is arranged below the pair of upper discharge rollers 50, at an interval from it. The discharge face 242T is a flat part arranged on the top end side of the connecting housing 23. The tray attachment portion 242S is arranged in a left end part of the discharge face 242T. With the second sheet discharge tray 242 attached to the tray attachment portion 242S, the discharge face 242T and the second sheet discharge tray 242 are flush with each other.

The left and right support portions 71 and 72 (both constituting a guide portion) are arranged on the top face of the connecting housing 23. The left and right support portions 71 and 72 have the function of supporting the corrugation member 60 such that the corrugation member 60 is movable up and down. The left and right support portions 71 and 72 are arranged at an interval from each other in the discharge direction of the sheet P (the left/right direction, the direction indicated by arrow DS in FIG. 3), across the roller shaft 501S. As shown in FIGS. 2 and 3, between the left and right support portions 71 and 72, the corrugation member 60 is arranged. The left support portion 71 is a protruding part, located to the left of the corrugation member 60, that extends in the horizontal direction. On the other hand, the right support portion 72 is a plate-shaped part, located to the right of the corrugation member 60, that extends in the vertical direction. With the corrugation member 60 attached to the connecting housing 23, the first and second hooks 604 and 606 of the corrugation member 60 make slidable contact with the right and left support portions 72 and 71 respectively. To allow the corrugation member 60 to move in the vertical direction more accurately with no inclination, the right support portion 72 in FIG. 4 may be arranged so as to extend further upward. It is preferable that, in the right support portion 72, a slit be formed along which the first hook 604 can slide. In that case, the position of the first hook 604 is restricted so that the corrugation member 60 can move up and down stably with no inclination.

The first and second guide faces 151 and 152 are guide faces that define an upstream-side part of the upper discharge passage P1 over the switch guide 134 (on the downstream side in the sheet conveyance direction). The third and fourth guide faces 153 and 154 are guide faces that define the upper discharge passage P1 on the downstream side of the first and second guide faces 151 and 152. A sheet P is guided by the third and fourth guide faces 153 and 154 toward the pair of upper discharge rollers 50. Moreover, when a sheet P is switched back as mentioned earlier, the sheet P is guided by the third and fourth guide faces 153 and 154 toward the two-sided conveyance passage P3. The fifth and sixth guide faces 155 and 156 are guide faces that define an entrance part of the two-sided conveyance passage P3. As shown in FIG. 2, the fifth and sixth guide faces 155 and 156 are curved faces that descend forward along the conveyance direction of the sheet P in the two-sided conveyance passage P3.

As mentioned previously, in the embodiment, the drive controller 82 controls the driver 81, and thereby controls the rotation direction of the first discharge roller 501 of the pair of upper discharge rollers 50. When a sheet P is to be discharged and stacked on the second sheet discharge tray 242 (FIG. 1), the drive controller 82 rotates the first discharge roller 501 in the first rotation direction (the direction indicated by arrow D1 in FIG. 4). On the other hand, for a sheet P to be subjected to two-sided printing, with the leading end side of the sheet P (the downstream side in the discharge direction) exposed in the discharge space 24, the drive controller 82 stops the rotation of the first discharge roller 501. At this time, the trailing end side (the upstream-side end part in the discharge direction) of the sheet P is located between the third and fourth guide faces 153 and 154 in FIG. 2 in the upper discharge passage P1, and the sheet P is nipped at the nip portion of the pair of upper discharge rollers 50. Thereafter, the drive controller 82 rotates the first discharge roller 501 in the second rotation direction (the direction indicated by arrow D2 in FIG. 4). As a result, the sheet P is conveyed into the two-sided conveyance passage P3, and is then convened once again into the sheet conveyance passage PP, which is located on the upstream side of the transfer nip portion TP.

To improve the stackability of sheets P on the second sheet discharge tray 242, it is preferable that the corrugation member 60 corrugate the sheet P. Even if the sheet P is curled or tends to droop under its own weight, the corrugation member 60 holds the sheet P in a position substantially flat in the horizontal direction. On the other hand, when a sheet P is switched back to be conveyed into the two-sided conveyance passage P3, if the corrugation member 60 presses the sheet face of the sheet P, the sheet P may be crimped (waved), and this tends to cause a leading end part of the sheet P (a trailing end part of it in the discharge direction) to collide with the fifth guide face 155, producing abnormal noise. Also, when the region of the sheet P waved by the corrugation member 60 is pressed by the corrugation member 60 again during switching-back, abnormal noise may be produced.

To solve this problem, in the embodiment, the sheet conveying device 1S is provided with a moving mechanism 60S. The moving mechanism 60S has the function of moving, according to the rotation direction of the first discharge roller 501, the corrugation member 60 between a first position, in which it makes contact with the sheet face of the sheet P, and a second position, in which it is located above, away from, the nip portion of the pair of upper discharge rollers 50. The moving mechanism 60S is composed of the transmission gear 61, the torque limiter 62, and the rack portion 605, all of which have been mentioned previously.

With reference to FIG. 4, in a case where a sheet P is discharged onto the second sheet discharge tray 242, when the first discharge roller 501 is rotated in the first rotation direction, the engagement of the transmission gear 61 with the rack gear 605G causes the corrugation member 60 to move down (arrow D3 in FIG. 4). Eventually, the first and second abutting portions 604A and 606A of the corrugation member 60 make contact with a top end part of the right and left support portions 72 and 71 respectively. As a result, downward movement of the corrugation member 60 is restricted, and thus the transmission gear 61 is acted on by an increased rotation load. The torque limiter 62 then lets the first discharge roller 501 rotate idly relative to the transmission gear 61, and thus the transmission gear 61 stops rotating. The position that the corrugation member 60 takes as a result of having moved downward due to the engagement of the transmission gear 61 with the rack gear 605G in this way is defined as the first position. FIGS. 2 to 4 show the corrugation member 60 in a state located in the first position. In this state, as the first discharge roller 501 rotates, the sheet P continues being discharged, and meanwhile the corrugation member 60 in the first position corrugates the sheet P. This improves the stackability of the sheets P discharged onto the second sheet discharge tray 242.

In the embodiment, the corrugation member 60 includes the downstream guide face 603. The downstream guide face 603 is inclined so as to ascend forward along the discharge direction of the sheet P toward the second sheet discharge tray 242. Thus, a trailing end part of the sheet P having passed through the nip portion of the pair of upper discharge rollers 50 is thrust out lower-leftward (to the downstream side in the discharge direction) (arrow DP in FIG. 3) by the downstream guide face 603. This prevents the trailing end part of the sheet P from stopping near the pair of upper discharge rollers 50.

On the other hand, in a case where a sheet P is switched back and is conveyed into the two-sided conveyance passage P3, when the first discharge roller 501 is rotated in the second rotation direction, the engagement of the transmission gear 61 with the rack gear 605G causes the corrugation member 60 to move up (arrow D4 in FIG. 4). Eventually, the third abutting portion 607 of the corrugation member 60 makes contact with a bottom end part of the left support portion 71. As a result, the upward movement of the corrugation member 60 is restricted, and thus the transmission gear 61 is acted on by an increased rotation load. The torque limiter 62 then lets the first discharge roller 501 rotate idly relative to the transmission gear 61, and thus the transmission gear 61 stops rotating. The position that the corrugation member 60 takes as a result of having moved up due to the engagement of the transmission gear 61 with the rack gear 605G is defined as the second position. The second position is located above the position of the corrugation member 60 in FIGS. 2 to 4. In this case, the corrugation portion 602 of the corrugation member 60 does not make contact with the sheet face of the sheet P that, having been switched back, is conveyed toward the two-sided conveyance passage P3. This permits the sheet P to bend (droop) easily, and thus even if a leading end part of the sheet P collides with the fifth guide face 155, the collision produces only suppressed abnormal noise.

As described above, the moving mechanism 60S moves the corrugation member 60 down when the first discharge roller 501 is rotated in the first rotation direction (the direction indicated by arrow D1 in FIG. 4), and moves the corrugation member 60 up when the first discharge roller 501 is rotated in the second rotation direction (the direction indicated by arrow D2 in FIG. 4). Thus, while the first discharge roller 501 is rotated in the first or second direction, the corrugation member 60 can be brought into contact with the sheet P only when the sheet P needs to be corrugated. Notably, it is possible to corrugate a sheet P when it is discharged onto the second sheet discharge tray 242 but to avoid corrugating the sheet P when it is conveyed in the opposite direction (toward the two-sided conveyance passage P3), Moreover, in the embodiment, the moving mechanism 60S is provided with the torque limiter 62. Thus, while the first discharge roller 501 is conveying a sheet P, when the corrugation member 60 corrugates the sheet P, the driver 81 is prevented from being acted on by an excessive load. Likewise, while the first discharge roller 501 is conveying the sheet P in the reverse direction, when the corrugation member 60 is located away from, above, the sheet P, the driver 81 is prevented from being acted on by an excessive load.

Moreover, in the embodiment, the engagement of the rotary gear with the rack gear allows the corrugation member to move up and down easily. Furthermore, the rack gear 605G is arranged on the upstream side of the transmission gear 61 in the discharge direction of the sheet P. Thus, even with a simple and compact structure in the rack gear 605G, it is possible to corrugate the sheet P when it is discharged onto the second sheet discharge tray 242 and to avoid corrugating the sheet P when it is conveyed in the direction opposite from the second sheet discharge tray 242.

It should be noted that the above description of an image forming apparatus according to the present disclosure is not meant to limit the present disclosure; for example, a modified embodiment as noted below is also possible.

Although the above embodiment deals with a configuration where a sheet P switched back by the pair of upper discharge rollers 50 is conveyed into the two-sided conveyance passage P3, this is not meant to limit the present disclosure; the sheet P switched back may instead be conveyed to any other discharge tray or the like.

As described above, a sheet conveying device 1S according to the present disclosure includes: a housing 23; a pair of conveying rollers 50 including a first roller 501 which is rotatably supported on the housing 23 and a second roller 502 which follows the first roller 501 to rotate and which forms between the first and second rollers 501 and 502 a nip portion through which a sheet P passes; a sheet stacking portion 242 onto which sheets P conveyed by the pair of conveying rollers 50 are discharged; a driver 81 which rotates the first roller 501 selectively either in a first rotation direction, in which the first roller 501 conveys the sheet P toward the sheet stacking portion 242, or in a second rotation direction, which is opposite to the first rotation direction; a corrugation member 60 which corrugates the sheet P by making contact with a sheet face of the sheet P passing through the nip portion; and a moving mechanism 60S which moves, according to the rotation direction of the first roller 501, the corrugation member 60 between a first position, where the corrugation member 60 makes contact with the sheet face, and a second position, where the corrugation member 60 is located away from the nip portion.

With this structure, when the first discharge roller 501 is rotated in the first or second rotation direction, wherever the sheet P needs to be corrugated, the corrugation member 60 can be brought into contact with the sheet P.

In the structure described above, preferably, the moving mechanism 60S moves the corrugation member 60 to the first position when the first roller 501 is rotated in the first rotation direction, and moves the corrugation member 60 to the second position when the first roller 501 is rotated in the second rotation direction. With this structure, it is possible to corrugate the sheet P when it is discharged onto the second sheet discharge tray 242, and to avoid corrugating the sheet P when it is conveyed in the direction opposite from the second sheet discharge tray 242.

In the structure described above, preferably, the sheet conveying device 1S further includes a shaft 501S which rotatably supports the first roller 501, and the moving mechanism 60S includes a rotary gear 61 which is fitted around the shaft 501S and a rack gear 605G which is provided in the corrugation member 60 and which meshes with the rotary gear 61. When the first roller 501 is rotated in the first rotation direction, the meshing of the rotary gear 61 with the rack gear 605G causes the corrugation member 60 to move to the first position and, when the first roller 501 is rotated in the second rotation direction, the meshing of the rotary gear 61 with the rack gear 605G causes the corrugation member 60 to move to the second position. With this structure, the meshing of the transmission gear 61 with the rack gear 605G allows easy up/down movement of the corrugation member 60.

In the structure described above, preferably, the moving mechanism 60S further includes a torque limiter 62 which is arranged between the rotary gear 61 and the shaft 501S and which either lets the rotary gear 61 and the shaft 501S rotate together or lets the roller shaft 501S rotate idly relative to the rotary gear 61. Preferably, the housing 23 includes a guide portion (71, 72) which supports the corrugation member 60 such that it can move up and down. Preferably, the corrugation member 60 includes a first locking portion (604A, 606A), and further includes a guided portion (a first hook 604 and a second hook 606) which makes slidable contact with the guide portion (71, 72). When the first roller 501 is rotated in the first rotation direction and the meshing of the rotary gear 61 with the rack gear 605G causes the corrugation member 60 to move down until the first locking portion (604A, 606A) makes contact with a top end part of the guide portion (71, 72), the torque limiter 62 lets the shaft 501S rotate idly relative to the rotary gear 61. With this structure, while the first discharge roller 501 is conveying the sheet P, when the corrugation member 60 corrugates the sheet P, the driver 81 is prevented from being acted on by an excessive load.

In the structure described above, preferably, the corrugation member 60 further a second locking portion (607) which is arranged under the first locking portion (604A, 606A). When the first roller 501 is rotated in the second rotation direction and the meshing of the rotary gear 61 with the rack gear 605G causes the corrugation member 60 to move up until the second locking portion (607) makes contact with a bottom end part of the guide portion (71, 72), the torque limiter 62 lets the shaft 501S rotate idly relative to the rotary gear 61. With this structure, while the first discharge roller 501 is conveying the sheet P in the reverse direction, when the corrugation member 60 is located away from the sheet P, the driver 81 is prevented from being acted on by an excessive load.

In the structure described above, preferably, the rack gear 605G is arranged on the upstream side of the rotary gear 61 in the discharge direction in which the sheet P is conveyed toward the sheet stacking portion 242. With this structure, the rack gear 605G provided in the corrugation member 60 has a simple structure. In addition, it is possible to corrugate the sheet P when it is discharged onto the second sheet discharge tray 242, and to avoid corrugating the sheet P when it is conveyed in the direction opposite from the second sheet discharge tray 242.

In the structure described above, preferably, the frictional force that occurs between the corrugation member 60 and the sheet P is set to be smaller than the frictional force that occurs between the first roller 501 and the sheet P. With this structure, while the sheet P is being conveyed by the pair of upper discharge rollers 50, even if the corrugation member 60 makes contact with the sheet face of the sheet P, the sheet P is prevented from severe hindrance of its conveyance.

In the structure described above, preferably, the corrugation member 60 includes a corrugation portion 602 which is arranged opposite the nip portion in the axial direction of the first roller 501 and which makes contact with the sheet face of the sheet P and an inclined face 603 which is arranged on the downstream side of the corrugation portion 602 in the discharge direction of the sheet P and which ascends forward in the discharge direction. With this structure, a trailing end part of the sheet P having passed through the nip portion of the pair of upper discharge rollers 50 is thrust out lower-leftward by the inclined face 603. This prevents the trailing end part of the sheet P from stopping near the pair of upper discharge rollers 50.

An image forming apparatus 1 according to the present disclosure includes: an image forming section 120 which forms an image on a sheet P; and a sheet conveying device 1S structured as described above. With this structure, when the first discharge roller 501 is rotated in the first or second rotation direction, wherever the sheet P needs to be corrugated, the corrugation member 60 can be brought into contact with the sheet P.

According to the present disclosure, it is possible to provide a sheet conveying device that improves the stackability of discharged sheets and that in addition reduces the abnormal noise that occurs when a sheet is switched back; it is also possible to provide an image forming apparatus provided with such a sheet conveying device.

What is claimed is:

1. A sheet conveying device, comprising:

a housing;

a pair of conveying rollers including a first roller which is rotatably supported on the housing, a shaft which rotatably supports the first roller, and a second roller which follows the first roller to rotate, the pair of conveying rollers forming between the first and second rollers a nip portion through which a sheet passes;

a sheet stacking portion on which sheets conveyed by the pair of conveying rollers are stacked;

a driver which rotates the first roller selectively either in a first rotation direction, in which the pair of conveying rollers conveys the sheet toward the sheet stacking portion, or in a second rotation direction, which is opposite to the first rotation direction;

a corrugation member which corrugates the sheet by making contact with a sheet face of the sheet passing through the nip portion;

a moving mechanism which moves, according to a rotation direction of the first roller, the corrugation member between a first position, where the corrugation member makes contact with the sheet face, and a second position, where the corrugation member is located away from the nip portion, wherein the moving mechanism includes a rotary gear which is penetrated through by the shaft and which rotates together with the shaft, and a rack gear which is provided in the corrugation member and which has, along a direction of movement of the corrugation member, a plurality of cogs that mesh with the rotary gear, when the first roller is rotated in the first rotation direction, meshing of the rotary gear with the rack gear causes the corrugation member to move to the first position and, when the first roller is rotated in the second rotation direction, the meshing of the rotary gear with the rack gear causes the corrugation member to move to the second position.

2. The sheet conveying device of claim 1, wherein the moving mechanism further includes a torque limiter which is arranged between the rotary gear and the shaft, the torque limiter letting the rotary gear and the shaft rotate together when a torque generated between the rotary gear and the shaft is equal to or smaller than a predetermined value, the torque limiter letting the rotary gear and the shaft rotate relative to each other when the torque generated between the rotary gear and the shaft is larger than the predetermined value.

3. The sheet conveying device of claim 2, wherein the housing includes a guide portion which supports the corrugation member such that the corrugation member is movable up and down, the corrugation member includes a first hook which extends from one end part of the corrugation member parallel to the rotary gear, the first hook having a first abutting portion in a tip end part thereof, the first hook being slidably supported on the guide portion, and a second hook which extends from another end part of the corrugation member opposite from the first hook, the second hook having a second abutting portion, the second hook being slidably supported on the guide portion, and when the first roller is rotated in the first rotation direction and the meshing of the rotary gear with the rack gear causes the corrugation member to move down until the first and second abutting portions come into contact with the guide portion, the torque limiter lets the shaft rotate idly relative to the rotary gear.

4. The sheet conveying device of claim 3, wherein the corrugation member further includes a third abutting portion which is arranged under the second abutting portion, and when the first roller is rotated in the second rotation direction and the meshing of the rotary gear with the rack gear causes the corrugation member to move up until the third abutting portion comes into contact with the guide portion, the torque limiter lets the shaft rotate idly relative to the rotary gear.

5. The sheet conveying device of claim 1, wherein the rack gear is arranged on an upstream side of the rotary gear in a discharge direction in which the sheet is conveyed toward the sheet stacking portion.

6. The sheet conveying device of claim 1, wherein a frictional force that occurs between the corrugation member and the sheet is set to be smaller than a frictional force that occurs between the first roller and the sheet.

7. The sheet conveying device of claim 1, wherein the corrugation member includes a corrugation portion which is arranged opposite the nip portion in an axial direction of the first roller and which makes contact with the sheet face of the sheet and an inclined face which is arranged on a downstream side of the corrugation portion in a discharge direction of the sheet and which ascends forward in the discharge direction.

8. The sheet conveying device of claim 4, wherein the rack gear is arranged on an upstream side of the rotary gear in a discharge direction in which the sheet is conveyed toward the sheet stacking portion, a frictional force occurring between the corrugation member and the sheet is set to be smaller than a frictional force occurring between the first roller and the sheet, and the corrugation member includes a corrugation portion which is arranged opposite the nip portion in an axial direction of the first roller and which makes contact with the sheet face of the sheet and an inclined face which is arranged on a downstream side of the corrugation portion in the discharge direction of the sheet and which ascends forward in the discharge direction.

9. An image forming apparatus, comprising:

an image forming section which forms an image on a sheet; and a sheet conveying device according to claim 1.

* * * * *